United States Patent [19]

Love

[11] 4,043,449

[45] Aug. 23, 1977

[54] GIFT PACKAGE CONTAINING MESSAGE BEARING UNIT AND USEFUL ARTICLE IN ASSOCIATION THEREWITH

[75] Inventor: Michael Love, Philadelphia, Pa.

[73] Assignee: Mida Mfg. Inc., Philadelphia, Pa.

[21] Appl. No.: 616,756

[22] Filed: Sept. 19, 1975

[51] Int. Cl.[2] ..... B65D 5/50; B65D 73/00; B65D 1/34

[52] U.S. Cl. ..... 206/45.14; 206/457; 206/566

[58] Field of Search ..... 206/75, 457, 459, 45.14, 206/45.19, 45.31, 566; 229/92.8

[56] References Cited

U.S. PATENT DOCUMENTS

| | | | |
|---|---|---|---|
| 313,100 | 3/1885 | Oliver | 206/472 |
| 1,494,006 | 5/1924 | Morrison | 206/45.31 |
| 1,691,781 | 11/1923 | Meyer | 206/45.19 |
| 1,713,584 | 5/1929 | Wolf | 206/216 |
| 2,147,135 | 2/1939 | Addis et al. | 206/45.19 |
| 2,676,699 | 4/1954 | Friedman | 206/45.19 |
| 3,430,761 | 3/1969 | Pelkey | 206/215 |

*Primary Examiner*—William T. Dixson, Jr.
*Attorney, Agent, or Firm*—Robert C. Podwil

[57] ABSTRACT

Useful articles, such as earrings or other articles of personal adornment, are functionally and aesthetically integrated with a greeting card-like message bearing unit, and the unit and articles are disposed within a container, the dimensions of the container corresponding to certain dimensions of the unit and the articles.

3 Claims, 3 Drawing Figures

GIFT PACKAGE CONTAINING MESSAGE BEARING UNIT AND USEFUL ARTICLE IN ASSOCIATION THEREWITH

This invention relates to a gift package, and more particularly, to a gift package which contains both a decorative message bearing unit and a useful article, such as earrings or the like, the article being so associated with the decorative matter of the card to provide an integrated visual effect.

It has heretofore been proposed that certain articles of merchandise be mounted on and offered to the public in combination with a greeting card. For example, U.S. Pat. No. 1,714,774, issued May 28, 1929, to Goldsmith discloses a gift card for a flexible article, such as a garter, wherein the article is mounted on the bottom leaf of a folded card, and is made to extend through a cutaway opening in the other, the top leaf. Although the Goldsmith patent does recognize that a picture or ornamentation may be provided on the card, no suggestion is made that the gift article become a part of the decorative aspect of the card, nor is there any suggestion that the card and gift be associated with a container and sold as a packaged gift article.

Card mounted articles have also been proposed for the purpose of shipping and display, but not as gift items. An example of such an apparatus is to be found in the U.S. Pat. No. 3,840,114, issued Oct. 8, 1974, to Sama.

Accordingly, it is an object of this invention to provide a novel gift package containing a message bearing unit and a useful article and association therewith.

It is another object of this invention to provide a gift package wherein a useful article is functionally and aesthetically integrated into a greeting card-like message bearing unit.

It is still another object of this invention to provide, as an article of manufacture saleable as a unit, a greeting card-like message bearing unit, a useful article aesthetically integrated into the message bearing unit, and a container for both the message bearing unit and the useful article.

The foregoing and other objects of this invention are realized, in a presently preferred form of the invention, by a gift package comprising a card having decorative matter and message bearing indicia thereon, and means on the card for coupling a gift article to the card. The gift article is removably coupled to the card, and a portion of the article is so juxtaposed to the decorative matter as to create a desired and attractive integrated decorative visual effect. A container is provided for the card and the gift article, the card being nestable within the container and a cover is provided for the container. Thus, the whole package, card, gift article and container, is saleable as a compact and attractive unit.

For the purposes of illustration, there is shown in the drawings and embodiment of the invention which is presently preferred, and understood, however, that this invention is not limited to the precise arrangements and instrumentalities shown.

Figure 1:
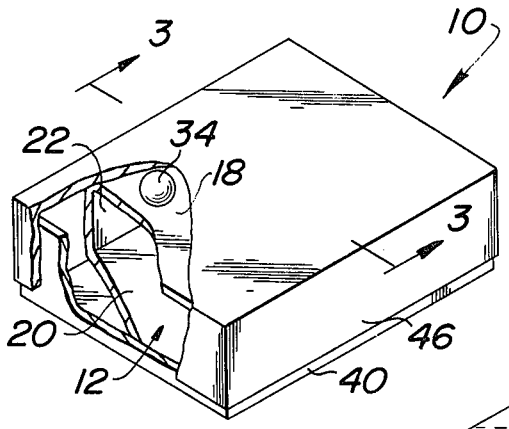
FIG. 1 is a perspective view, partly broken away, of a gift package in accordance with the invention.
Figure 2:
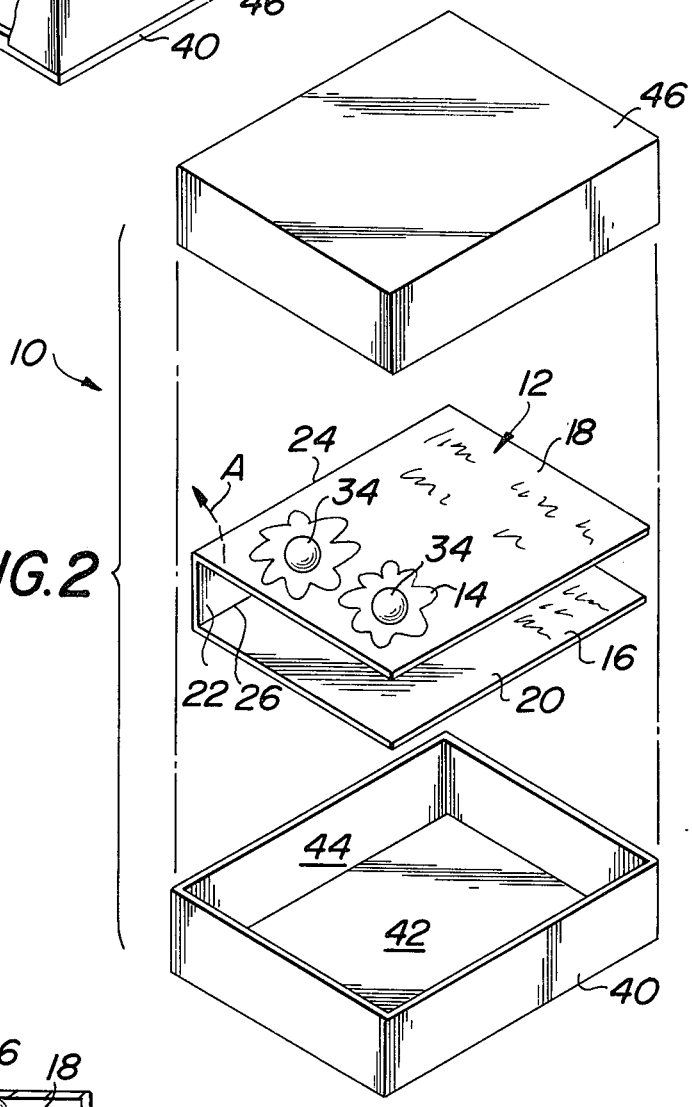
FIG. 2 is a perspective view, exploded in form, showing the structural and functional interrelationship of various elements of the invention.

Referring now to the drawings in detail, wherein like numerals indicate like elements, there is seen in FIGS. 1 and 2 a gift package designated generally by the reference numeral 10. Disposed in the gift package 10 is a greeting card-like message bearing unit or card, designated generally by the reference numeral 12. The card 12 carries decorative matter 14, which may be applied to it by conventional printing or other equivalent techniques, and message bearing indicia 16, which may be similarly applied. The word "message" is used here in its broadest sense, and may denote birthday, anniversary or other such greetings, or non-specific novelty types of greetings.

The card 12, in the illustrated and presently preferred form of the invention, includes a first leaf member 18 and a second leaf member 20, interconnected by a spine-like panel 22. The leaf members 18 and 20 are movable with respect to each other in book-like fashion, by rotation with respect to the respective fold lines 24 and 26 between them and the spine panel 22. With reference to FIG. 2, the arrow "A" indicates, diagrammatically, the direction of movement of the leaf member 18.

Mounted on the leaf member 18 is a gift article, a pair of earrings 28 in the illustrated form of the invention, and means are provided on the card 12 to facilitate such mounting.

Figure 3:
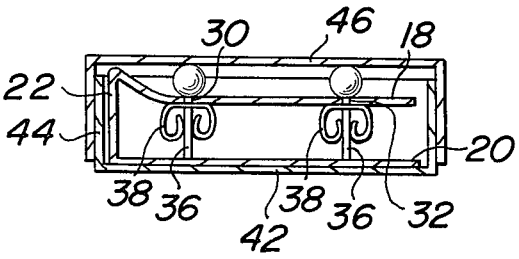
FIG. 3 is a cross-sectional view, in side elevation, taken along the line 3—3 in FIG. 1.

In the illustrated form of the invention, these means take the form of openings 30 and 32 in the leaf member 18, seen in cross-section in FIG. 3.

Referring once against to FIG. 2, the relationship between the earrings 28 and the decorative matter 14 of the card 12 may be seen.

Referring to FIG. 3, the earrings 28 shown in the drawings are of conventional construction for such items intended for "pierced" ears, and each comprises a spherical head portion 34 and a pin portion 36 which would project, in use, through the ear of a wearer. The head portions 34 are aesthetically integrated into the decorative matter 14 on the face of the leaf 18, preferably by means of their spatial orientation with respect to the decorative matter 14, and by color coordination with such decorative matter. Thus, in the illustrated form of the invention, the head portions 34 represent, in three dimensions and in attractive and eye-catching relief from the face of the leaf 18, the central parts of designs of flowers, the petals and other portions of the flowers, and the rest of the decorative matter 14 appearing in two dimensions on the face of the leaf 18. Numerous other aesthetically integrated designs will, of course, occur to those skilled in the art.

The pin portions 36 have in association with them conventional clasps 38, which, in use, would serve to retain the pin portions 36 in the ears of a wearer. For the purposes of this invention, the clasps 38 also provide a convenient means by which the earrings 28 may be retained in association with the card.

With reference once against to FIGS. 1 and 2, a container is provided for the card 12 and the gift articles associated with it, so as to create the unitary gift package 10. The container comprises a receptacle portion 40, having bottom and side walls 42 and 44, respectively, and a cover or closure portion 46, the dimensions of the receptacle portion 40 being such that card 12 is nestable within the receptacle portion with the leaf 20 overlying the bottom wall 42 and the spine-like panel 22 abutting a side wall 44.

The pin portions 36 of the earrings 28 and spine-like panel 22 serve to maintain the leaf 18 in spaced relation with respect to the leaf 20. In this regard, as is seen in FIG. 3, the pin portions extend, when the cover portion 46 is in place, into engagement with the leaf 20. Thus, when the cover portion is removed, the leaf 18 will be approximately in the plane of the open mouth of the receptacle portion 40, and both its indicia 14 and the gift articles coupled to it will be readily visible and attractively displayed.

The present invention may be embodied in other specific forms without departing from its spirit or essential attributes, and accordingly, reference should be made to the appended claims, rather than to the foregoing specification, as indicating the scope of the invention.

I claim:

1. A gift package comprising a card having decorative matter and message-bearing indicia thereon, means on said card for coupling a gift article thereto, a gift article removably coupled to said card and having a portion thereof juxtaposed to said decorative matter so that said decorative matter and said portion create an integrated visual effect, said card comprising first and second leaf members coupled to each other so as to be openable in book fashion, said gift article being coupled to said first leaf member, and a container for said card and said gift article, said container comprising a receptacle portion, said card being nestable within said receptacle portion, and a cover portion for enclosing said card and said gift article, said receptacle portion comprising bottom wall and spaced side walls, said second leaf member of said card overlying said bottom wall when said card is nested within said receptacle portion, and a portion of said gift article projecting into engagement with said second leaf member so as to maintain said first leaf member in spaced relation with respect to said second leaf member when said card is nested within said receptacle portion.

2. A gift package in accordance with claim 1, wherein said card comprises a spine-like panel interconnecting said first and second leaf members, said panel being juxtaposed to one side wall of said receptacle portion when said card is nested within said receptacle portion.

3. A gift package in accordance with claim 2, wherein said gift article comprises a pair of earrings, each of said pair having a head portion and a pin portion, said means for coupling said gift article to said card comprising openings in said first leaf member, said pin portions extending through said openings when said earrings are coupled to said card, said portion of said gift article projecting into engagement with said second leaf member being said pin portions, and clasp means coupled to said pin portions for affixing said earring to said first leaf.

* * * * *